US006214513B1

(12) United States Patent
Cai et al.

(10) Patent No.: US 6,214,513 B1
(45) Date of Patent: Apr. 10, 2001

(54) SLOT COATING UNDER AN ELECTRIC FIELD

(75) Inventors: Jian Cai, Penfield; Robert F. Dunham, Walworth; Merle Emil Scharfe, Penfield, all of NY (US); Ian D. Morrison, Acton, MA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/449,355

(22) Filed: Nov. 24, 1999

(51) Int. Cl.[7] ..... G03G 5/00

(52) U.S. Cl. ..... 430/129; 430/132; 430/134; 118/621; 118/624; 264/452; 425/174.6; 427/457; 427/470

(58) Field of Search ..... 430/129, 132, 430/134; 118/621, 624; 264/452; 425/174.6; 427/457, 470

(56) References Cited

U.S. PATENT DOCUMENTS

| | | | | |
|---|---|---|---|---|
| 4,265,990 | | 5/1981 | Stolka et al. | 430/96 |
| 4,390,611 | | 6/1983 | Ishikawa et al. | 430/72 |
| 4,439,507 | | 3/1984 | Pan et al. | 430/66 |
| 4,521,457 | | 6/1985 | Russell et al. | 427/286 |
| 4,548,570 | * | 10/1985 | Hahn et al. | 425/174.6 |
| 4,551,404 | | 11/1985 | Hiro et al. | 430/72 |
| 4,588,667 | | 5/1986 | Jones et al. | 430/73 |
| 4,596,754 | | 6/1986 | Tsutsui et al. | 430/72 |
| 4,797,337 | | 1/1989 | Law et al. | 430/72 |
| 4,943,508 | * | 7/1990 | Yu | 430/129 |
| 4,965,155 | | 10/1990 | Nishiguchi et al. | 430/77 |
| 5,004,662 | | 4/1991 | Mutoh et al. | 430/72 |
| 5,525,376 | * | 6/1996 | Leonard | 427/470 |
| 5,531,872 | | 7/1996 | Forgit et al. | 430/127 |
| 5,603,770 | * | 2/1997 | Sato | 118/621 |
| 5,614,260 | | 3/1997 | Darcy | 430/277 |
| 6,048,658 | * | 4/2000 | Evans et al. | 430/132 |

FOREIGN PATENT DOCUMENTS

| | | | | |
|---|---|---|---|---|
| 0409570A2 | * | 1/1991 | (EP) | 427/457 |
| 1520898 | * | 8/1978 | (GB) | 430/129 |
| 899357 | * | 1/1982 | (RU) | 264/452 |

* cited by examiner

*Primary Examiner*—Mark Chapman
(74) *Attorney, Agent, or Firm*—Oliff & Berridge, PLC

(57) ABSTRACT

A coating process for the fabrication of organic photoreceptors employs an electrically conductive single slot die biased to allow an electric field between the die and the ground plane on the photoreceptor substrate. The homogenous coating dispersion is fed through the die at a predetermined gap and rate to control coating thickness at the same time that an electric field is applied. The formulation, rheology, particle mobility, coating speed, electric field and the like are controlled so that the photogenerator particles migrate to the substrate in the dwell time defined by the coating die region.

24 Claims, 3 Drawing Sheets

SLOT COATING UNDER AN ELECTRIC FIELD

BACKGROUND OF THE INVENTION

1. Field of Invention

This invention generally relates to a process for applying a coating material to a surface of a substrate. More particularly, this invention relates to a process for applying a charge generating material to a photoreceptor substrate, and to photoreceptors made by such a process.

2. Description of Related Art

Among the many conventional methods of coating a substrate with a coating material is the use of an extrusion or slot die from which the coating material is extruded onto the substrate. Using such slot coating of thin layers, the window of operating parameters is extremely small and is affected by factors such as the coating thickness, the speed of the substrate, the theological properties of the coating liquids, the vacuum pressure, the relative speed of the extruded coating material, the amount of pressure applied to the coating material as it progresses through the extrusion slot, etc.

Extrusion coating methods for forming thin layers are described in U.S. Pat. Nos. 4,521,457 and 5,614,260, the entire disclosures of which are totally incorporated herein by reference.

Such extrusion coating methods have conventionally been used to manufacture Xerographic photoreceptors. Xerographic photoreceptors are typically prepared using either a single layer configuration or a multilayer configuration. The multilayer arrangement is more common. In the multilayer configuration, the active layers are the charge generation layer (CGL) and the charge transport layer (CTL). Charge generation layers are usually prepared as dispersions of pigment particles in a polymer host. Most charge generation layers conventionally range from between 0.1 and 5 microns in dry thickness. In contrast, transport layers conventionally range from about 20 to 29 microns thick. In the multilayer configurement, additional layers, such as blocking, adhesion, overcoat and undercoard layers may optionally be included as desired.

Generally, each of the charge generation and charge transport layers is applied separately onto a substrate. The charge generation layer is typically coated onto a blocking layer, under which there can be an undercoat layer for providing adhesion and optionally a blocking function over the substrate. Then, the charge transport layer is typically coated over the charge generation layer.

The use of conventional extrusion slot die methods of forming thin coatings of dispersions of photoconductive particles can produce defects resembling brush marks along each edge of the deposited coating. These brush marks can remain as defects in the dried coating and can ultimately print out as undesirable artifacts in the final electrophotographic copy.

The coating materials for charge generation layers of photoreceptors can be Newtonian but are often made of Non-Newtonian dispersions, which show shear thinning, thixotropic and yield stress behaviors. The dispersion shows little or no deformation up to the yield stress, which can lead to flocculation of dispersion particles in the coated film.

U.S. Pat. No. 5,531,872 to Forgit et al., the entire disclosure of which is incorporated herein by reference, discloses a static process for fabricating a photoconductive member including depositing a photoconductive material, such as a charge generating material, and a charge transport material on a substrate, sequentially in any order, or simultaneously. The photoconductive material, the charge transport material, or both, are electrophoretically deposited onto the substrate from a liquid composition using a voltage of from 8 to 60 volts to create an electric field. The electrophoretic deposition is accomplished by maintaining the electric field for up to five minutes.

SUMMARY OF THE INVENTION

It is difficult to slot coat a high quality single layer coating of a charge generation layer onto a substrate because of generally low liquid viscosity, shear thinning and yielding stress due to the nature of the dispersion and the typically extremely thin layer requirements. For example, the benzimidazole perylene (BzPe) and Hydroxygallium phthalocyanine (HOGaPc) binder system solutions that are commonly used to produce photoreceptors have very narrow coating windows. The resulting coating yields can be lower than desired. Thus, a need exists for improved coating methods that provide higher yield and higher quality of coated substrates.

This invention provides systems and methods for coating a moving substrate using a slot die with an applied electric field.

In various exemplary embodiments of the systems and methods of this invention, a charge generator layer dispersion is fed from a coating die containing a single slot onto a moving substrate. An electrical field is imposed between the coating die and the moving substrate. The dispersion particles that form the charge generation layer have charges. Thus, under the electrical field, these particles deposit on the substrate while still in the coating gap region.

A charge generating layer can be "developed" out using the single slot die to provide a CGL or both a CGL and a CTL simultaneously with the single slot. Thus, a two layer coating can be produced using only a single slot die and a single coating solution. This eliminates one entire coating step while improving both productivity and yield. Alternatively, a simultaneous two slot coating can be used with the CGL and CTL being initially separated and deposited from the separate slots.

This invention can be used to produce electrostatographic charge generating material with an increased yield, better layer properties, thinner layers and increased throughput.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following drawing figures, in which.

DETAILED DESCRIPTION OF PREFERRED EMBODIMENTS

Figure 1:
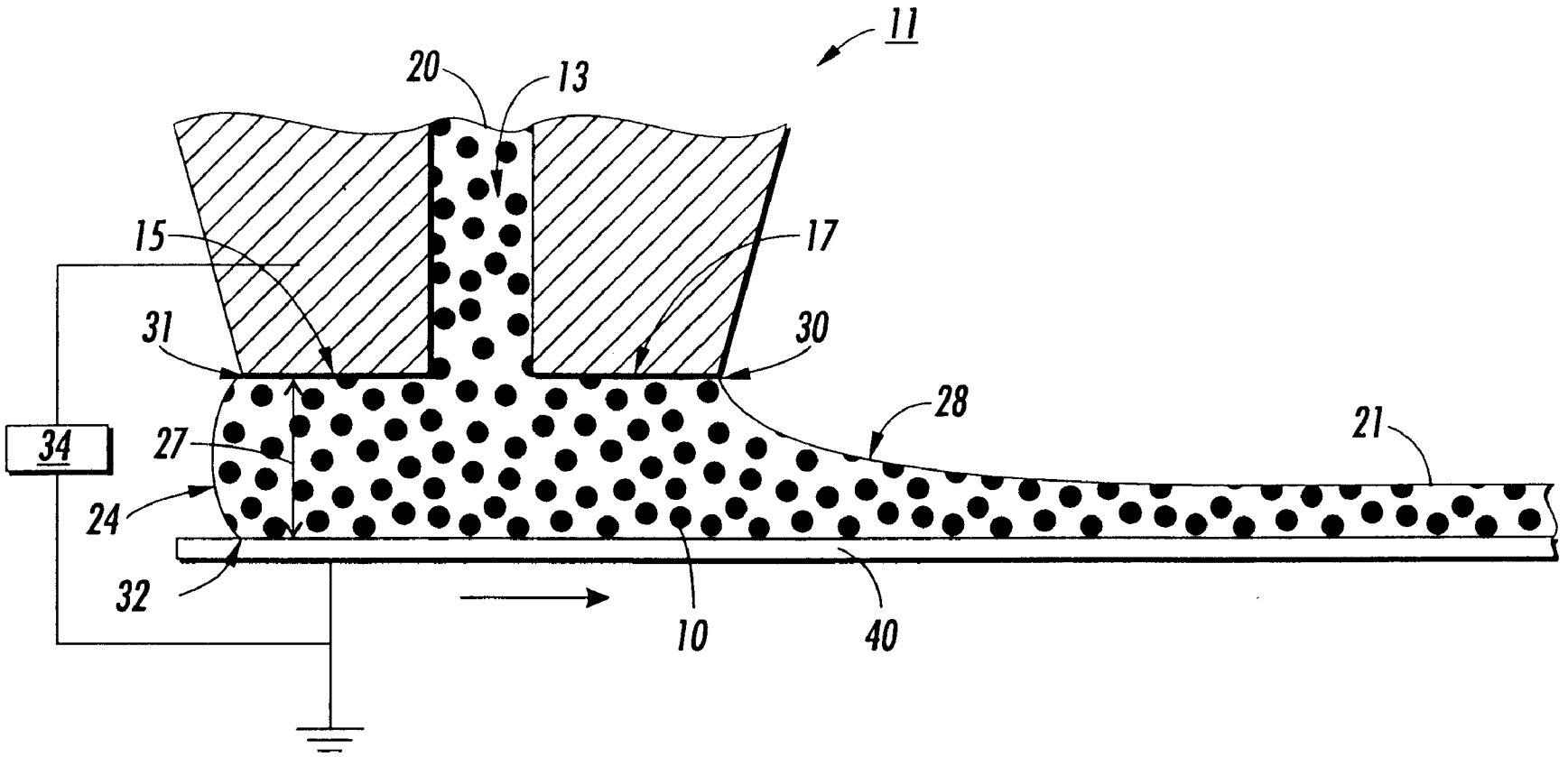
FIG. 1 schematically illustrates the use of a single slot die for coating a charge generation layer or a charge generating layer and a charge transport layer under an electrical field in accordance with an exemplary embodiment of this invention.

FIG. 1 generally illustrates an exemplary embodiment of a single slot system for coating using an electrical field.

The single slot system includes a slot die 11. The slot die 11 includes a feed slot 13 defined by an upstream lip 15 and a downstream lip 17.

An electric field is applied to the die 11 through an electrical field generating system featuring a static contact line 30, that can be pinned to and located near the downstream end of the downstream lip 17 of the die 11, and a static contact line 31, that can be connected to and located near the upstream end of the upstream lip 15 of the die 11, in conjunction with dynamic contact line 32, that can be connected to the ground plane (or other suitable location) on the substrate 40 or on the substrate transport device (not shown). The electrical field application system can be powered by a power supply 34 that can utilize alternating current in combination with direct current. Of course, various modifications of the electrical field generating system will be apparent to one of ordinary skill in the art, and the present invention is not limited to the exemplary system shown in FIG. 1. In general, it is possible to utilize an AC voltage sufficient to enable adequate shear combined with a DC voltage that will cause migration of the pigment particles toward the substrate.

In an exemplary embodiment of a process using a single slot die according to this invention, a feed material 20 is added through the feed slot 13 to form a liquid film 21 on a moving substrate 40. In one particularly exemplary embodiment, the feed material is a dispersion containing either a charge generating component or both charge generating type and charge transport type components. The charge generating type component preferably contains charged pigment particles, such as particles 10 as illustrated.

An electrical field is generated between the die 11 and the substrate 40 by powering on the power supply 34. As the substrate 40 moves along through the coating gap 27 (the distance between the substrate 40 and the slot in the die 11) region (the area between the substate 40 and the die 11), the charged particles 10 contained in the feed material 20, which will form the charge generation layer, are pulled by the electrical field toward the substrate 40. In this fashion, a single layer is generally formed on the substrate 40. In the combined charge generating and charge transport layer, the single layer thus contains a compositional gradient with the composition closest to the substrate containing a substantially higher percentage of charge generating material and the composition furthest away from the substrate containing a substantially higher percentage of charge transport (or other) material.

Vacuum pressure, for example between 0 to 1000 Pa, can be applied to the upstream end of the system such that an upstream miniscus 24 is formed upstream from the feed slot 13.

A downstream miniscus 28 is naturally formed downstream from the feed slot 13 as the substrate 40 moves away from the die 11.

In an embodiment in which the feed material includes both a charge generating material and a charge transport material, the two types of materials can be applied together from a single solution. The charge generating materials will include the charged component, in the form of charged particles, which will be pulled closer to the substrate by the electric field. Thus, in this embodiment, the electric field will tend to form two layers from the single feed solution.

Although the invention has been described above as a system containing only a single slot coating die, the present invention is in no way limited to such an embodiment. Thus, while the one slot coating die system provides particularly advantageous results, such as in terms of process efficiency, a coating die having two or more slots, or two or more coating dies each having one or more slots, can be used in embodiments, as desired. For example, two or more slots can be used to apply the same coating material, or to apply different coating materials. Likewise, although the present invention has been described in FIG. 1 as applying a charge generating material, or combine a charge generating and charge transporting material, the present invention can be used to apply other coating materials, and is in particular applicable to the application of coating materials having component(s) that are suited for the electrical field application technique.

Figure 2:
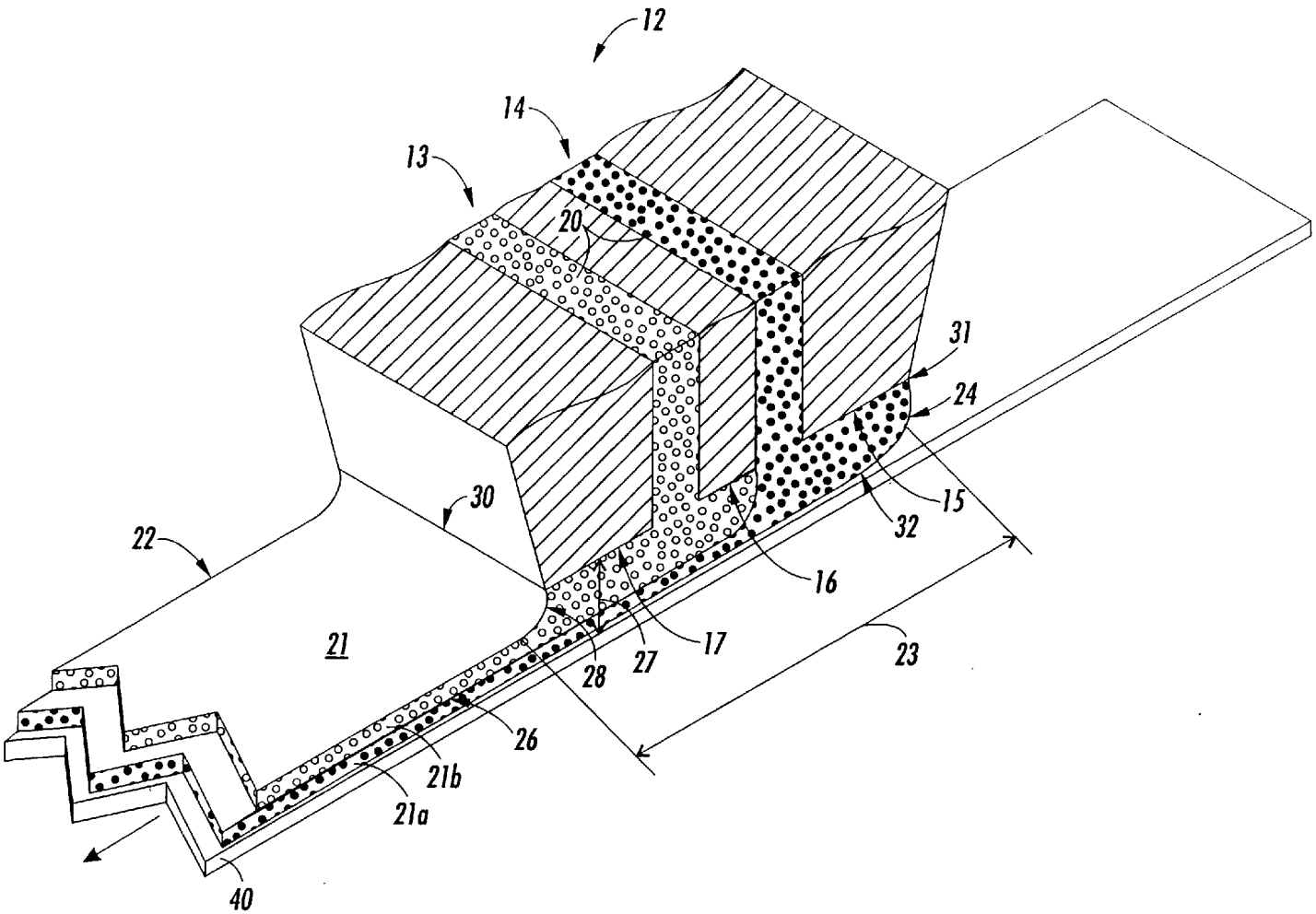
FIG. 2 schematically illustrates the use of a two slot die for coating a charge generation layer and a charge transport layer under an electrical field in accordance with an exemplary embodiment of this invention.

FIG. 2 generally illustrates an exemplary embodiment of a two slot system for coating a charge generation or both a charge generation and charge transport layer onto a substrate using an electrical field.

The two slot system includes a slot die 12. The slot die 12 includes a first feed slot 14 defined by an upstream lip 15 and an intermediate lip 16. The slot die 12 also includes a second feed slot 13 defined by the intermediate lip 16 and a downstream lip 17.

In an exemplary embodiment of a process using a two slot die according to this invention, normally two different materials are added through the feed slots 13 and 14 to form a liquid film 21 onto a substrate 40. The liquid film is defined by an edge 22. In one most exemplary embodiment, the feed material is a dispersion containing a charge transport material in the feed slot 13 and a dispersion containing a charge generator type components in the feed slot 14. The charge generating type material preferably contains charged pigment particles.

In FIG. 1, an electrical field is generated between the die 11 and the substrate 40 by powering on the power supply 34. As the substrate 40 moves along through the coating gap region, the charged particles contained in the fluid material 20, which will form the charge generation layer, are pulled by the electrical field toward the substrate 40. In this fashion, two layers 21*a* and 21*b* are generally formed on the substrate, although some mixing may occur near the interface of the two layers. The layer 21*a* closest to the substrate, which will generally contain substantially all of the charge generating material, may contain a compositional gradient with the composition closest to the substrate containing a higher percentage of charge generating material and the composition furthest away from the substrate containing less of the charge generating material and more of any non-charged (or less charged) carrier component or components.

Vacuum pressure can be applied to the upstream end of the system such that an upstream miniscus 24 is formed upstream from the feed slots 13 and 14.

A downstream miniscus 28 is naturally formed downstream from the feed slots 13 and 14 as the substrate moves away from the die 11.

The electric field can be applied to the die 11 through an electrical field generating system featuring a static contact line 30, that can be connected to and located near the downstream end of the downstream lip 17 of the die 11, and a static contact line 31, that can be connected to and located near the upstream end of the upstream lip 15 of the die 11, in conjunction with dynamic contact line 32, that can be connected to the substrate 40. The electrical field application system can be powered by a power supply or other device (not shown) which utilizes alternating current and/or direct current. Of course, as described above, various modifications of the electrical field generating system will be apparent to one of ordinary skill in the art, and the present invention is not limited to the exemplary system shown in FIG. 2.

Figure 3:
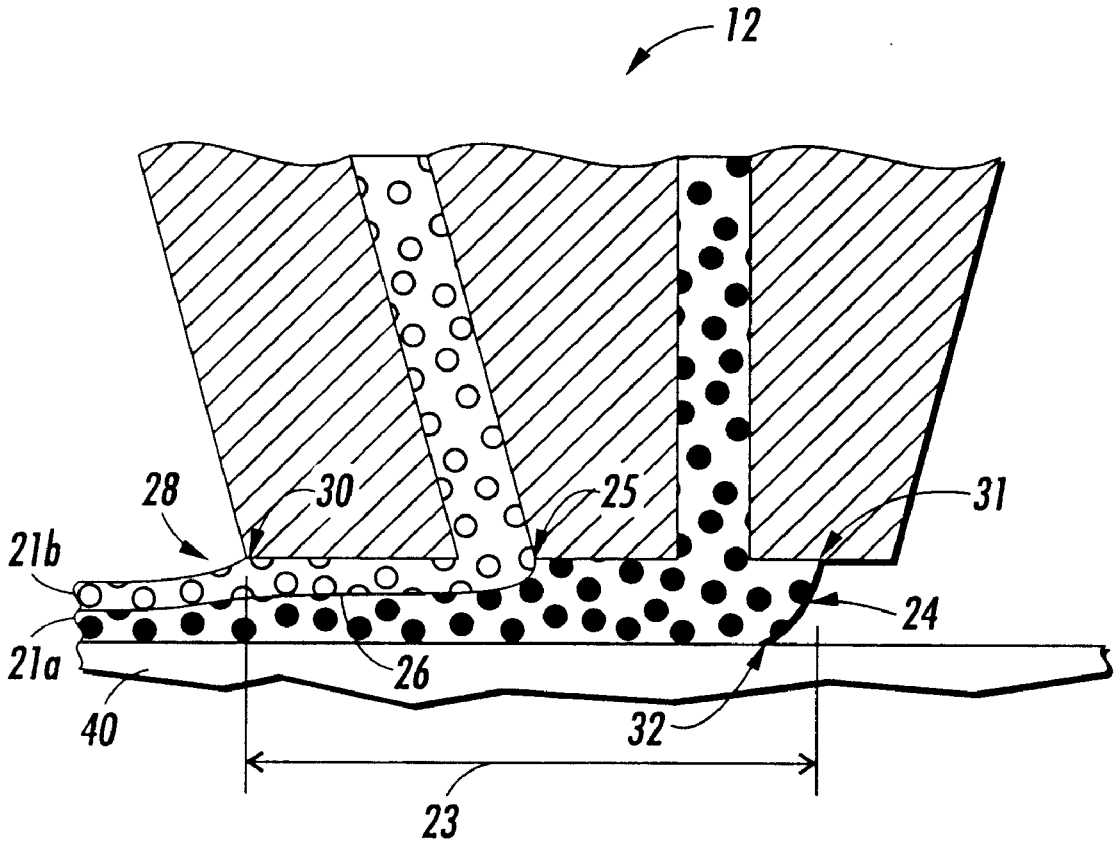
FIG. 3 schematically illustrates the use of a two slot die for coating a charge generation layer and a charge transport layer under an electrical field in accordance with an exemplary embodiment of this invention.

FIG. 3 further generally illustrates an exemplary embodiment of a two slot system for coating charge generation and transport layers onto a substrate using an electrical field.

A separation point 25 is formed at the entrance of the charge transport material dispersion. An interlayer 26 is thus formed between the charge transport "layer" 21*b* and the charge generation "layer" 21*a*.

A downstream miniscus 28 is formed downstream from the feed slot 13.

As in FIG. 2, in FIG. 3, in an exemplary embodiment of a process in accordance with this invention, an electric field is applied to the die 11 through a electrical field generating system featuring a static contact line 30, that can be connected to and located near the downstream end of the downstream lip 17 of the die 11, and a static contact line 31, that can be connected to and located near the upstream end of the upstream lip 15 of the die 11, in conjunction with dynamic contact line 32, that can be connected to the substrate 40. The electrical field application system, identical or similar to those described above, can be powered by a power supply, which utilizes alternating current and/or direct current.

Materials that can be utilized for the various elements of this invention, including the components of the charge generating layers and charge transport materials, are disclosed in the following U.S. Patents, the entire disclosure of each of which is incorporated herein by reference: U.S. Pat. Nos. 4,265,990; 4,390,611; 4,551,404; 4,588,667; 4,596,754; 4,797,337; 4,965,155; 5,004,662 and 5,531,872.

An extrusion die that can be used in this invention can include spaced walls or lands, each having a flat surface generally parallel to and facing the other. These spaced lands form a narrow, elongated, extrusion passageway having an entrance slot at one end and an exit slot at the opposite end of the passageway. The passageway can have side walls to direct the flow of a thin ribbon shaped stream of coating composition. Generally, the coating composition is supplied by a reservoir or manifold positioned along the length of the entrance slot of the extrusion passageway. The coating composition liquid generally travels from a pump through a feed channel, such as a pipe, to the manifold of the extrusion die. The coating composition liquid is distributed by the manifold into the entrance slot of the extrusion passageway. The coating composition liquid then travels through the extrusion passageway and out the exit slot onto a substrate to be coated. A typical photoreceptor extrusion die manifold has a cavity in the shape of a cylinder having a straight imaginary axis. This cylindrical cavity has a constant cross sectional area from one end of the cavity to the opposite end. The feed channel or feed pipe is connected to the manifold cavity midway between the opposite ends of the cavity. The feed channel has an imaginary axis that is perpendicular to the imaginary axis of the cylindrical manifold cavity to form a "T" shaped configuration. The coating composition liquid supplied by the feed channel is distributed by the manifold to an extrusion passageway connected to the manifold. The extrusion passageway conveys the coating material liquid from the manifold and shapes it into a thin ribbon-like extrudate, which is thereafter deposited as a coating onto a substrate. After layers are deposited, the coated photoreceptor web can subsequently be sliced to form rectangular sheets, which can be formed into a belt type photoreceptor by welding opposite ends of the sheet together.

The transit time, or the time it takes the charge dispersion particles to drift from the die exit to the substrate due to the electric field, is represented by t. In particular, t is equal to $L/\mu E$, where L is the coating gap, i.e., the distance between the coating die and the substrate, $\mu$ is the mobility of the particle, and E is the electrical field.

To ensure the deposition of particles on the substrate while still in the coating gap region, the transit time of the pigment particles should be shorter than the transit time of the web through the coating gap region.

Any suitable voltage can be applied to form the electric field in the system. However, in order to provide a relatively short transit time, a voltage of 300–3000 Volts is preferably employed to create the electrical field. More preferably, an electrical field of 300–500 Volts is employed to create the electrical field.

The substrate can be moved at any suitable velocity to enable coating of the substrate. For example, according to embodiments of the present invention, a velocity of 25–100 feet per second is particularly preferred.

Any suitable organic photoconductive charged particles may be utilized in the coating dispersions used in the extrusion process of this invention. The organic photoconductive particles useful in the process of this invention are generally pigments, which form a dispersion in a solution of a film forming binder dissolved in a liquid solvent, the dispersion having a measurable substantially constant yield stress value. Typical organic photoconductive particles include, for example, but are not limited to, various phthalocyanine pigments such as the X-form of metal free phthalocyanine, metal phthalocyanines such as hydroxy gallium phthalocyanine, titanyl phthalocyanine, vanadyl phthalocyanine and copper phthalocyanine; perylenes such as benzimidazole perylene; quinacridones; dibromo anthanthrone pigments; substituted 2,4-diamino-triazines; polynuclear aromatic quinones; and the like and mixtures thereof. Generally, the organic photoconductive pigment particles have an average particle size between about 0.2 micrometer and about 0.4 micrometer.

Any suitable film forming polymer soluble in a solvent may be used in the coating dispersion used in the process of this invention. Typical film forming polymers include, for example, but are not limited to, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like.

Any suitable solvent may be utilized to dissolve the film forming polymer and form the coating dispersion. In embodiments, the solvent should preferably not dissolve the organic photoconductive pigment particles and should preferably be a solvent for the film forming binder. Typical solvents include, for example, but are not limited to, methylene chloride, tetrahydrofuran, toluene, methyl ethyl ketone, isopropanol, methanol, cyclohexanone, heptane, other chlorinated solvents, and the like.

Any suitable proportion of organic photoconductive pigment particles, solvent and film forming binder may be employed to form the dispersion. Typical weight portions include about 1.4 to about 2 percent by weight organic photoconductive pigment particles, about 93 to about 94 percent by weight solvent and about 3.5 to about 5 percent by weight film forming binder, based on the total weight of the dispersion. Of course, contents outside of these ranges can be used, in embodiments, as desired. The organic photoconductive, i.e. charge generation, particles can be present in the film forming binder matrix of the final dried coating in various amounts. Generally, from about 5 percent by volume to about 90 percent by volume of the organic photoconductive particles are dispersed in about 10 percent by volume to about 95 percent by volume of the film forming binder, and preferably from about 20 percent by volume to about 30 percent by volume of the organic photoconductive particles are dispersed in about 70 percent by volume to about 80 percent by volume of the film forming binder. The final dried charge generating layer generally ranges in thickness of from about 0.1 micrometer to about 5 micrometers, and can have, for example, a thickness of from about 0.3 micrometer to about 3 micrometers. The charge generation layer thickness is related to film forming polymer content. Higher film forming polymer content compositions generally require thicker layers for photogeneration. Thicknesses outside these ranges can be selected providing the objectives of the present invention are achieved. Drying of the deposited coating may be effected by any suitable conventional technique such as oven drying, infra red radiation drying, air drying and the like.

The extrusion process and system of this invention may be employed to coat the surface of support members of various configurations including webs, sheets, plates, and the like. The support member may be flexible, rigid, uncoated, precoated, as desired. The support members may comprise a single layer or be made up of multiple layers. The substrate may be insulating or conductive and, if desired, precoated with layers such as conductive layers, adhesive layers, charge blocking layers and the like. These layers are conventional and well known in the art of electrostatography and described for example in U.S. Pat. Nos. 4,265,990 and 4,439,507, the entire disclosures of these patents being incorporated herein by reference.

A charge transport layer may be formed on the charge generating layer formed by the extrusion coating process of this invention or, alternatively, the charge transport layer may be formed on the substrate prior to application of the charge generating layer formed by the extrusion coating process of this invention. Alternatively, as described above, the charge transport layer can be applied concurrently with the charge generating layer, either in a combined coating material (such as in a single slot coating die) or in immediately subsequent coatings (such as in a multiple slot coating die). Where the charge generating layer and charge transport layer are applied separately, the charge transport layer can be applied either by the same coating process as used for the charge generating later, or by any of the various coating processes known in the art.

The charge transport layer may comprise any suitable transparent organic polymer or non-polymeric material capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the charge generation layer from abrasion or chemical attack and therefor extends the operating life of the photoreceptor imaging member. The charge transport layer should exhibit negligible, if any, discharge when exposed to a wavelength of light useful in the electrostatographic process for which the photoreceptor is employed. Therefore, the charge transport layer is substantially transparent to radiation in a region in which the photoconductor is to be used. Thus, the active charge transport layer is a substantially non-photoconductive material, which supports the injection of photogenerated holes from the charge generation layer. The charge transport layer in conjunction with the charge generation layer is a material that is an insulator to the extent that an electrostatic charge placed on the charge transport layer is not conducted in the absence of illumination.

The active charge transport layer may comprise any suitable activating compound useful as an additive dispersed in electrically inactive polymeric materials making these materials electrically active. These compounds may be added to polymeric materials that are incapable of supporting the injection of photogenerated holes from the charge generation layer and incapable of allowing the transport of these holes therethrough. This will convert the electrically inactive polymeric material to a material capable of supporting the injection of photogenerated holes from the charge generation layer and capable of allowing the transport of these holes through the active layer in order to discharge the surface charge on the active layer.

The charge transport layer forming mixture can comprise an aromatic amine compound. One exemplary charge transport layer employed comprises from about 35 percent to about 45 percent by weight of at least one charge transporting aromatic amine compound, and about 65 percent to about 55 percent by weight of a polymeric film forming resin in which the aromatic amine is soluble. The substituents should be free from electron withdrawing groups such as $N0_2$ groups, CN groups, and the like. Typical aromatic amine compounds include, but are not limited to. for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'biphenyl)-4,4'-diamine, and the like dispersed in an inactive resin binder.

Any suitable inactive resin binder, for example, a binder soluble in methylene chloride, chlorobenzene or other suitable solvent, may be employed in the process of this invention. Typical inactive resin binders include, but are not limited to, polycarbonate resin, polyvinylcarbazole, polyester, polyarylate, polyacrylate, polyether, polysulfone, and the like.

Other than the present invention, a suitable and conventional technique may be utilized to mix and thereafter apply the charge transport layer coating mixture to the charge generation layer. Typical application techniques include spraying, dip coating, roil coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, and for example, between about 20 micrometers and about 29 micrometers, but thicknesses outside this range can also be used provided that there are no adverse effects.

Other layers such as conventional ground strip layers, overcoating layers and anticurl backing layers may also be applied to the photoreceptor, if desired. Such layers can be provided in known amounts and by known methods to provide their respective purposes.

Thus, the process of this invention provides an improved process for extrusion coating of dispersion coating compositions to form a dried coating having a very thin and uniform thickness with fewer defects. Also, the process of this invention forms a photoreceptor that does not produce undesirable artifacts in the final electrophotographic copy.

Although the present invention has generally been described above as applying a charge generating material, the invention is not limited to such layers. Rather, the present invention can be used to apply any material to form a layer, where the material includes at least one charged component. For example, the present invention could be used to coat a undercoat layer (UCL) with dispersed particles to stop plywood.

While this invention has been described in conjunction with specific embodiments described above, it is evident that many alternatives, modifications and variations will be apparent to those skilled in the art. Accordingly, the preferred embodiments of the invention, as set forth above, are intended to be illustrative not limiting. Various changes may be made without departing from the spirit and scope of the invention.

What is claimed is:

1. A method of coating a substrate, comprising:

moving at least one substrate to be coated past at least one orifice in a coating die;

depositing a coating composition that includes at least one charged component from the at least one orifice onto the at least one substrate during said moving; and applying an electrical field that moves the at least one charged component toward the substrate.

2. The method of claim 1, wherein the at least one charged component is an electrostatographic charge generating material.

3. The method of claim 2, wherein a direct current voltage of 300–3000 Volts is employed to create the electrical field.

4. The method of claim 3, wherein the direct current voltage is 300–500 Volts.

5. The method of claim 3, wherein the substrate is moved at a velocity of 25–100 feet per second.

6. The method of claim 3, wherein floculation of the dispersion is prevented.

7. The method of claim 3, wherein the coating die discharges a charge transport material and a charge generation material comprising substantially all of the charged component comprised of charged particles, onto the substrate such that a charge generation layer is formed substantially under a charge transport layer.

8. The method of claim 7, wherein the charge generation layer is about 0.1 to 5 microns thick and the charge transport layer is about 20–29 microns thick.

9. The method of claim 7, wherein the charge generation material and the charge transport material are included in a single solution that is discharged from a single one of said at least one orifice.

10. The method of claim 7, wherein the charge generation material is discharged from a first of said at least one orifice and the charge transport material is discharged from a second of said at least one orifice.

11. The method of claim 2, wherein both a direct current and an alternating current are employed to create the electrical field.

12. The method of claim 2, wherein the coating die has a single orifice and the charge generating material is a dispersion containing charged particles and a liquid material.

13. The method of claim 2, wherein said at least one orifice is a plurality of orifices, each of said plurality of orifices dispensing a different coating material.

14. The method of claim 13, wherein said plurality of orifices is two slots, and a first of the two slots is upstream of a second of the two slots, and the first slot discharges the electrostatographic charge generating material, which contains charged particles, onto the substrate forming a charge generation layer, and the second of the slots discharges a charge transport material over the first layer forming a charge transport layer.

15. The method of claim 14 wherein the charge generation layer is about 1 micron to about 3 microns in thickness and the charge transport layer is about 20 microns to about 29 microns in thickness.

16. A photoreceptor produced using the method of claim 2.

17. The method of claim 1, wherein the coating die is a slot coating die.

18. The method of claim 17, wherein substantially all of the charged particles are deposited onto the substrate while the substrate is still in a coating gap region.

19. The method of claim 1, wherein the step of depositing comprises feeding a homogenous coating dispersion through an electrically conductive single slot die at a predetermined gap and rate to control a coating thickness, and wherein said electric field is applied during said depositing step.

20. A coating on a substrate formed by the method of claim 1 having enhanced thinness and substantially uniform thickness with fewer defects.

21. A method of making a photoreceptor, comprising:

applying a charge generating layer to a substrate according to the method of claim 1; and applying a charge transporting layer to the charge generating layer.

22. A method for fabricating a photoreceptor, comprising:

moving at least one substrate to be coated, at a velocity of 25–100 feet per second, past at least one orifice in a coating die;

depositing a coating composition that includes at least one charge generating material from the at least one orifice onto the at least one substrate during said moving; and creating an electrical field under a voltage of 300–3000 Volts that moves the at least one charge generating material toward the substrate, forming a charge generating material coating on the substrate in which the density of the charged particles within the charge generating material coating varies in a depth direction of the substrate.

23. A coating apparatus, comprising:

means for moving at least one substrate to be coated past at least one orifice in a coating die;

means for depositing a coating composition that includes at least one charged component from the at least one orifice onto the at least one substrate during said moving; and means for creating an electrical field that moves the at least one charged component toward the substrate.

24. The coating apparatus of claim 23, wherein the charged component is an electrostatographic charge generating material.

* * * * *